US005607029A

United States Patent [19]

Beckham

[11] Patent Number: 5,607,029

[45] Date of Patent: Mar. 4, 1997

[54] SAFETY DEVICE

[76] Inventor: Doyle K. Beckham, 301 E. Fort Lowell Rd., Tucson, Ariz. 85705

[21] Appl. No.: 528,806

[22] Filed: Dec. 26, 1995

[51] Int. Cl.[6] ..... A62B 35/00

[52] U.S. Cl. ..... 182/3; 182/113; 248/228.4; 248/228.5

[58] Field of Search ..... 182/3, 45, 113; 256/DIG. 6, 59; 248/228.1, 228.3, 228.4, 228.5

[56] References Cited

U.S. PATENT DOCUMENTS

| | | | |
|---|---|---|---|
| 3,217,833 | 11/1965 | Smith | 182/3 |
| 3,747,898 | 7/1973 | Warren | 256/59 |
| 3,938,619 | 2/1976 | Karabayashi | 182/113 |
| 4,171,032 | 10/1979 | Woolslayer | 182/3 |
| 5,029,670 | 7/1991 | Whitmer | 182/113 |
| 5,263,550 | 11/1993 | Jones | 256/DIG. 6 |

*Primary Examiner*—Alvin C. Chin-Shue
*Attorney, Agent, or Firm*—Cahill, Sutton & Thomas P.L.C.

[57] ABSTRACT

A post member supports a stationary lower jaw and a movable upper jaw. Two openings in the upper jaw are spaced one above the other the same distance apart as a plurality of equispaced openings on the post member. A pair of pins are insertable into the openings in the upper jaw and openings in the post member to secure the upper jaw in position on the post member. With a pin in place in the upper opening in the upper jaw and a pin removed from the lower opening in the upper jaw that jaw can be tilted upwardly about the pin in the upper opening to facilitate installation of the post member and jaws on a beam.

2 Claims, 1 Drawing Sheet

SAFETY DEVICE

TECHNICAL FIELD

This invention concerns a device to attach a workman safety line to a beam in a construction project.

BACKGROUND ART

Workman installing roofing or flooring on the beam structure of a construction project run great risk of injury in falls from the beam structure. The risk of injury can be substantially reduced by attaching a strong safety line, or cable, to a stationary part of the structure, such as a beam.

U.S. Pat. No. 3,217,833 granted Nov. 16, 1965 to D. W. Smith for "Safety Device" discloses a system for connecting the belt of a workman to a metal I-beam with a rigid elongated metal bar. The attachment to the I-beam slides along the beam to permit the workman to move back and forth on the beam. The system disclosed, however, virtually precludes any side to side movement of the workman thereby limiting his activities.

Worker safety considerations prompted at least two other patented inventions. A perimeter guard rail post which can be clamped on the edge of a concrete slab is the subject of U.S. Pat. No. 3,747,895 granted Jul. 24, 1973 to W. E. Warren for "Guard Rail Post." And U.S. Pat. No. 3,938,619 granted Feb. 17, 1976 to K. Kurabayaski for "Stanchion" discloses a handrail supporting post that is adapted to be clamped onto an I-beam. Both of these patents disclose apparatus which is fairly complex and expensive to produce.

There continues to be a need for a reliable, easily fabricated adjustable device for attaching a worker safety line to a beam.

DISCLOSURE OF THE INVENTION

The safety device of this invention is easily fabricated from standard metal channel and tube shapes. It comprises an upright, elongated post member having a plurality of equispaced openings along its length. Affixed to the lower end of the post is a first jaw adapted to extend beneath a beam. Disposed above the first jaw is a second jaw which is adjustably moveable up and down the post to accommodate beams of different thicknesses. This second jaw is of an inverted, U-shape configuration with two depending legs. One of the legs of the second jaw has a pair of openings therein which are spaced one above the other the same distance as the space between adjoining openings in the post. A pair of pins which extend through the openings in the second jaw leg and two selected openings in the post fix the second jaw in position on the post. Removal of the pin from the lower opening in the second jaw leg permits the second jaw to be swung upwardly around the upper pin to facilitate installation of the device on a beam. The device also includes means for attaching a life line to the device.

BRIEF DESCRIPTION OF THE DRAWINGS

The invention is described in greater detail hereinafter by reference to the accompanying drawings wherein.

BEST MODE FOR CARRYING OUT THE INVENTION

Figure 1:
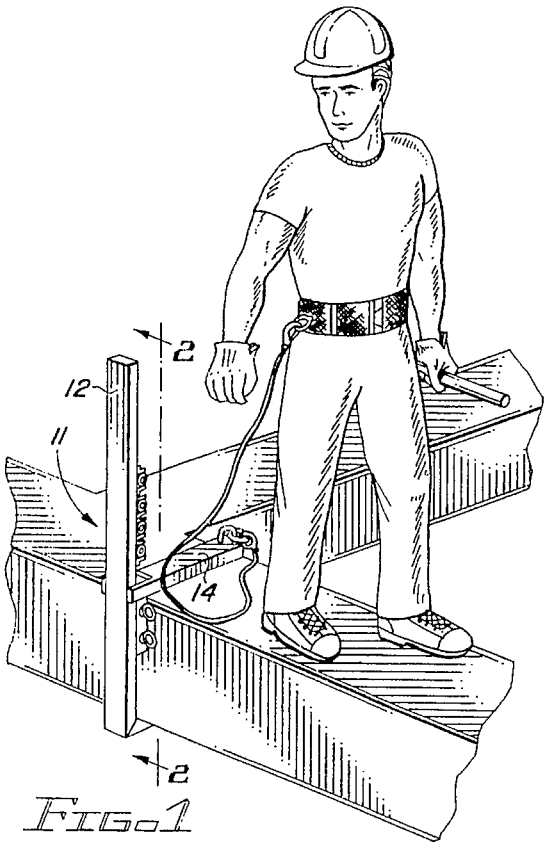
FIG. 1 is a perspective view illustrating the safety device of this invention secured to a beam of a construction project for anchoring one end of a safety line also attached to a workman.
Figure 2:
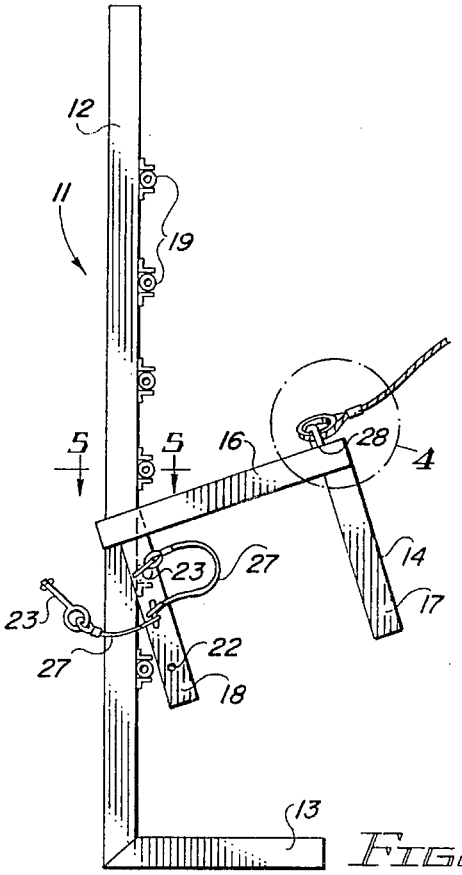
FIG. 2 is an elevational view of the safety device opened for installation on a beam.
Figure 3:
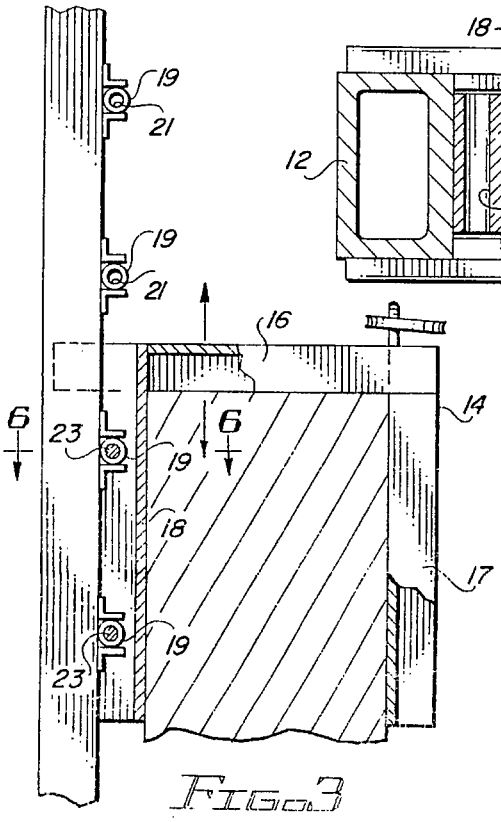
FIG. 3 is an enlarged elevational view of an upper jaw of the device in place on a beam with portions broken away to illustrate its construction.
Figure 5:
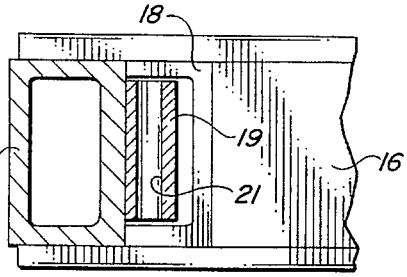
FIG. 5 is an enlarged sectional view taken generally as indicated by line 5—5 in FIG. 2.

The safety device of this invention is designated in the drawings generally by reference numeral 11. The principal components of the device are an upright, elongated post member 12, a first, or lower, jaw 13 attached to the lower extremity of the post and a second, or upper, jaw 14.

Post member 12 is preferably formed from rectangular steel tubing as is the lower jaw 13 which is welded to its extremity. Upper jaw 14, which is adapted to be positioned at various heights above lower jaw 13 to accommodate beams of differing thicknesses, is preferably fabricated from steel C-channels. The upper jaw 14 is of inverted U-shape configuration with a transverse section 16 and depending leg sections 17 and 18.

For the purpose of adjustably positioning the upper jaw 14 on the post member 12 a series of short tubes 19 are affixed, as by welding, to the post members. Tubes 19 are equally spaced along the post member 12 and provide pin receiving openings 21 up and down the post.

Figure 6:
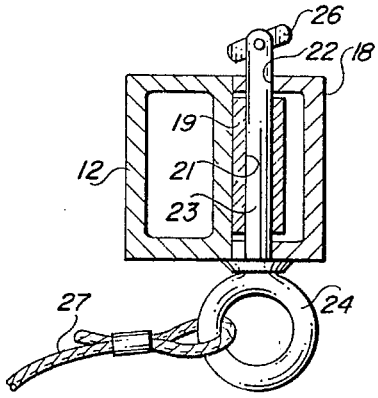
FIG. 6 is an enlarged sectional view taken generally as indicated by line 6—6 in FIG. 3.

Depending leg 18 of upper jaw 14 is provided with upper and lower pin receiving openings 22. The spacing between the openings in jaw 14 matches exactly the spacing between adjacent openings 21 provided along post 12. Upper jaw 14 can be moved up or down post 12 to any position in which the openings 22 in its leg line up with any two openings 21 on post 12 and then secured in that position by the insertion of two hitch pins 23 through the lined up openings (See FIG. 6). Each hitch pin 23 preferably has a ring 24 at one end and a swivel catch 26 at its other end. The ring 24 of each pin 23 facilitates handling and manipulating the pin and the swivel catch 25 insures against accidental dislodgement of the pin.

Each hitch pin 23 is also connected to the upper jaw 14 by a flexible lanyard 27 to prevent loss of the pins when they are free of the holes in the upper jaw.

To install the device 11 on a beam the upper jaw 14 is positioned along post member 12 with the distance between the lower jaw 13 and the transverse section 16 of the upper jaw is only slightly greater than the height of the beam onto which the device is to be installed. Upper jaw 14 is pinned in this position by inserting but one hitch pin 23 in the upper opening 22 in the jaw leg 18 and through an aligned opening 21 on the post. The other hitch pin 23 at this point is kept free of the upper jaw.

Actual installation of the safety device is performed by a worker grasping the upper extremity of the post member 12 and a portion of the upper jaw 14. The upper jaw is swung upwardly about the one installed hinge pin 23 widening the gap between the jaw leg 17 and the lower jaw 13 permitting the upper jaw 14 to be slid down over the beam. Thereafter the post member is rotated to an upright position sliding lower jaw 13 under the beam. The second hinge pin 23 is then installed in the lower opening 22 in jaw leg 18 to lock the device onto the beam in a secure fashion.

Figure 4:
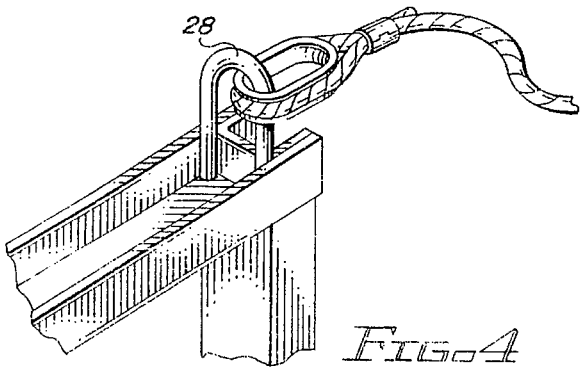
FIG. 4 is a perspective detail illustrating how a life line may be attached to the device.

The final component of the safety device is a means for securely attaching one end of a flexible safety line to the device. The attachment preferably takes the form of a steel bar eyelet 28 welded onto the transverse section 16 of upper jaw 14 (See FIG. 4).

What is claimed is:

1. A device for anchoring a workman safety line to a beam in a construction project, said device comprising an upright, elongated post member, said post member having a plurality of pin receiving openings spaced equidistant along its length, a first jaw secured to a lower region of said post member, a second jaw positioned above said first jaw and adapted to be adjustably moved up and down the post member, said second jaw having an inverted, U-shape configuration with two depending legs, one of the legs of the second jaw having a pair of openings therein spaced one above the other the same distance as the spacing between the openings in said post member, first and second pins adapted to be inserted into the openings in the leg of said jaw and through two openings in said post members for stationarily positioning the second jaw on said post member, the construction being such that with a pin removed from the lower opening in said jaw leg said second jaw can be tilted upwardly about the pin in the upper opening in the jaw leg to facilitate installation of the device on a beam, and means for attaching a safety line to the device.

2. The device of claim 1 further comprising flexible retainer cables attached to said pins and said second jaw.

* * * * *